US008567474B2

(12) United States Patent
Lin

(10) Patent No.: US 8,567,474 B2
(45) Date of Patent: Oct. 29, 2013

(54) WINDOW COVERING SAFETY DEVICE

(75) Inventor: Tzong Fu Lin, Taipei (TW)

(73) Assignee: Whole Space Industries Ltd, Taipei (TW)

( * ) Notice: Subject to any disclaimer, the term of this patent is extended or adjusted under 35 U.S.C. 154(b) by 220 days.

(21) Appl. No.: 12/855,113

(22) Filed: Aug. 12, 2010

(65) Prior Publication Data

US 2010/0299883 A1 Dec. 2, 2010

Related U.S. Application Data

(62) Division of application No. 11/975,028, filed on Oct. 17, 2007, now Pat. No. 7,841,376.

(51) Int. Cl.
*E06B 9/00* (2006.01)

(52) U.S. Cl.
USPC ..... 160/178.1 R; 160/349.1

(58) Field of Classification Search
USPC ..... 160/178.1 R, 349.1, 349.2; 24/116 A, 24/128, 543
See application file for complete search history.

(56) References Cited

U.S. PATENT DOCUMENTS

| | | | | | |
|---|---|---|---|---|---|
| 268,573 | A | * | 12/1882 | Throp | 160/349.1 |
| 1,381,817 | A | * | 6/1921 | Freeman | 160/349.1 |
| 1,833,298 | A | * | 11/1931 | Oakey | 24/72.5 |
| 2,302,741 | A | * | 11/1942 | Carlile | 29/441.1 |
| 2,440,012 | A | * | 4/1948 | Haver | 24/30.5 R |
| 2,644,992 | A | * | 7/1953 | McFarland | 24/116 A |
| 3,125,790 | A | | 3/1964 | Gaylord | |
| 3,168,768 | A | * | 2/1965 | Bohlinger et al. | 24/116 A |
| 3,172,178 | A | * | 3/1965 | Copell | 24/3.13 |
| 3,335,468 | A | * | 8/1967 | Harley | 24/115 R |
| 4,233,714 | A | * | 11/1980 | Panicci | 24/664 |
| 4,529,025 | A | * | 7/1985 | Oskam | 160/178.1 V |
| 4,727,921 | A | | 3/1988 | Vecchiarelli | |
| 4,865,108 | A | | 9/1989 | Hennequin et al. | |
| 4,909,298 | A | | 3/1990 | Langhart et al. | |
| 5,069,264 | A | | 12/1991 | Klawiter | |
| 5,504,977 | A | | 4/1996 | Weppner et al. | |
| 5,533,559 | A | | 7/1996 | Judkins | |
| 5,592,983 | A | | 1/1997 | Sartini et al. | |
| 5,630,458 | A | | 5/1997 | Holden | |
| 5,634,244 | A | | 6/1997 | Fetsch et al. | |

(Continued)

OTHER PUBLICATIONS

European Search Report for Application No. 08018233.0 dated Jan. 24, 2012.

*Primary Examiner* — Blair M. Johnson
(74) *Attorney, Agent, or Firm* — Buchanan Ingersoll & Rooney PC

(57) ABSTRACT

A window covering is disclosed that has a safety device that includes a first cord segment having stops spaced along the first cord segment, and a second cord segment having stops spaced along the second cord segment. The first cord segment and the second cord segment extend from respective end caps. The end caps are configured to connect to the ends of a bottom rail. A first anchor is connected to the first cord segment, and a second anchor is connected to the second cord segment. At least one of the first end cap and the first anchor is configured to releasably connect to the first cord segment at a selected stop on the first cord segment and at least one of the second anchor and the second end cap is configured to releasably connect to the second cord segment at a selected stop on the second cord segment.

9 Claims, 5 Drawing Sheets

(56) References Cited

U.S. PATENT DOCUMENTS

| | | | | |
|---|---|---|---|---|
| 5,676,188 | A | 10/1997 | Cadorette | |
| 5,771,952 | A | 6/1998 | Gabriel | |
| 5,845,696 | A | 12/1998 | Chou | |
| 6,044,889 | A | 4/2000 | Liu | |
| 6,053,236 | A | 4/2000 | Judkins et al. | |
| 6,085,824 | A | 7/2000 | Cadorette | |
| 6,273,173 | B1 | 8/2001 | Lassen | |
| 6,338,378 | B1 | 1/2002 | Kold | |
| 6,431,248 | B1 | 8/2002 | Hyman et al. | |
| 6,484,787 | B1 | 11/2002 | Walters | |
| 6,637,493 | B1 | 10/2003 | Lampers | |
| 6,681,831 | B1 | 1/2004 | Cheng et al. | |
| 6,684,930 | B2 | 2/2004 | Palmer et al. | |
| 6,775,936 | B2 | 8/2004 | Padiak et al. | |
| 6,802,356 | B2 | 10/2004 | Lin | |
| 6,860,312 | B2 | 3/2005 | Judkins | |
| 6,918,425 | B2 | 7/2005 | Nien | |
| 6,948,546 | B2 | 9/2005 | Nien | |
| 6,955,208 | B2 | 10/2005 | Kim | |
| 7,000,672 | B2 | 2/2006 | Nien | |
| 7,086,446 | B2 | 8/2006 | Kollman et al. | |
| 7,096,917 | B2 | 8/2006 | Ciuca et al. | |
| 7,114,545 | B2 | 10/2006 | Null | |
| 7,117,918 | B2 | 10/2006 | Franssen | |
| 7,216,687 | B2 | 5/2007 | Franssen | |
| 7,225,850 | B2 | 6/2007 | McCarty et al. | |
| 7,261,138 | B2 | 8/2007 | Judkins et al. | |
| 7,318,251 | B2 | 1/2008 | Lin | |
| 7,353,857 | B2 | 4/2008 | Koop | |
| 7,841,376 | B2 * | 11/2010 | Lin | 160/178.1 R |
| 2003/0111190 | A1 | 6/2003 | Palmer et al. | |
| 2006/0117526 | A1 | 6/2006 | Lin | |
| 2006/0144526 | A1 | 7/2006 | McGinley | |
| 2007/0023149 | A1 | 2/2007 | Lamars et al. | |
| 2011/0017409 | A1 * | 1/2011 | Houghton | 160/181 |

* cited by examiner

WINDOW COVERING SAFETY DEVICE

CROSS REFERENCE TO RELATED APPLICATIONS

The present application is a divisional application of U.S. patent application Ser. No. 11/975,028, which was filed on Oct. 17, 2007.

FIELD OF INVENTION

The present invention relates to safety devices for window coverings.

BACKGROUND OF THE INVENTION

Small children occasionally entangle themselves within the cords of window coverings, such as venetian blinds, when guardians fail to properly supervise the children. A child can become entangled within the cords of a venetian blind by pulling on a lift cord extending between the bottom rail and the headrail. Such pulling raises the bottom rail and creates an inner cord loop that can become entangled with the child. This can occur because the bottom rail of the venetian blind is not prevented from moving upward. In some cases, such entanglement causes injury or even the death of the child. Consequently, many consumers prefer to purchase window coverings that help mitigate, if not eliminate, the risk of such cord entanglement.

U.S. Pat. Nos. 4,909,298, 5,630,458, 6,484,787 and 6,637,493 disclose safety mechanisms that generally attempt to prevent injury to children from entanglement with operator cords that extend from the headrail to raise and lower the blind. These disclosed safety mechanisms generally attempt to position the pull cords of window coverings that are used to lift or lower blinds away from a small child's reach to prevent the child from becoming entangled within the operator cords. Such devices, however, often fail to prevent the entanglement of children with an inner lift cord of a lowered window covering because they do not prevent the bottom rail of such window coverings from being raised. Consequently, children can pull the inner lift cords away from the window covering and become entangled within the cords that are pulled away from the window covering.

U.S. Pat. Nos. 7,000,672 and 6,918,425 disclose methods of affixing the lift cords of a window covering to prevent the lift cords or any operator cords from being pulled by a child. The disclosed methods usually require the lift cords of the window covering to be affixed to the window frame to prevent repositioning or substantial movement of the bottom rail of the window covering by an operator cord or by wind or other force acting through an open window.

For example, U.S. Pat. No. 7,000,672 teaches that guide cords should extend through the bottom rail of the window covering and be affixed to the bottom of a window frame. A cord lock mechanism in the bottom rail of the window covering may then be disengaged to reposition the blind along the affixed guide cords by tilting the bottom rail to move the cord lock to an unlocked position. Once the cord lock within the bottom rail is moved to the unlocked position, the bottom rail may be raised or lowered along the affixed guide cords.

U.S. Pat. Nos. 7,117,918 and 5,533,559 also disclose mounting devices for the guide cords of a blind that are affixed to a window frame. U.S. Pat. No. 7,117,918 to Fransen, for example, discloses a two part mounting device that includes a ratchet and pawl mechanism. One portion of the mounting device is affixed to the window frame and the other portion is slidable along the affixed portion to permit the distance between the affixed guide cords to be altered. The sliding portion can also be slide completely off the affixed portion to disconnect the guide cords from the window frame.

Additionally, U.S. Pat. No. 6,948,546 discloses a device for affixing the bottom rail of a window covering to a window frame by connecting the bottom rail to the window frame by releasable retaining cords that extend from the headrail of a venetian blind. The retaining cords extend from the headrail of the window covering and are releasably connected to the window frame by a sheltering cap that is connected to a snap member affixed to the window frame. When a child's neck or head engages the retaining cords, the cap disconnects from the snap member, permitting the retaining cords to hang from the bottom rail.

Such loose retaining cords, however, expose children to entanglement dangers associated with such cords. Further, the cap and snap members are disclosed for use with non-cord operated blinds. Such devices are not designed for use with cord operated blinds, such as typical venetian blinds or cellular shades because those window coverings do not have guide cords or retaining cords affixed to the window frame adjacent the shade or blind. Instead, such blinds typically have lift cords that extend from the headrail of a window covering to window covering material that are manipulated to raise or lower the window covering material.

U.S. Pat. Nos. 4,727,921 and 5,069,264 also disclose mechanisms for holding down the bottom rail of a window covering. Because the bottom rail of the window covering is held down, the blind can be prevented from swinging due to wind blowing through an open window. U.S. Pat. No. 5,069,264 discloses a hold down bracket that has a portion that is configured to attach to an end of a bottom rail and a portion that is configured with holes so it can be affixed to the window frame adjacent the window covering by screws or nails. Such hold down brackets maintain the position of the window covering. The bottom rail of the window covering can be released from the bracket to raise or reposition the window covering.

U.S. Pat. No. 4,727,921 discloses a window covering that has spring biased projections that extend from the ends of a bottom rail to engage sides of a window frame adjacent the window covering. The projections may interlock within holes formed in the window frame, which can prevent the bottom rail from movement. The projections must be disengaged from the holes in order to raise the window covering.

Hold down devices such as the devices disclosed in U.S. Pat. Nos. 4,727,921 and 5,069,264 often limit a user to only one lowered position in which the bottom rail of a window covering may be affixed to the window frame. Further, hold down brackets such as the ones disclosed in U.S. Pat. No. 5,069,264 are often noticeable and can detract from the aesthetic effect of the window covering or the window frame.

A safety device is needed that prevents small children from pulling the inner lift cords of a window covering away from the blind to prevent the child from becoming entangled within the pulled portion of the inner lift cords. The safety device preferably prevents the bottom rail of a window covering from being substantially raised to prevent the pulling of such cords, but is adjustable to permit a user to adjustably lock the position of the bottom rail so the window covering can be maintained at one of several selected lowered positions.

SUMMARY OF THE INVENTION

A window covering is provided that includes a headrail, window covering material, a plurality of lift cords extending from the headrail to the window covering material, a bottom rail and a safety device. The bottom rail can be attached to the headrail, lift cords, window covering material or any combination thereof. The safety device includes a first cord segment that has a plurality of stops spaced along the first cord segment. The first cord segment extends from a first end cap. The first end cap is sized and configured to connect to the first end of the bottom rail. A first anchor is connected to the first cord segment. At least one of the first end cap and the first anchor is sized and configured to connect to the first cord segment at a selected stop on the first cord segment. The device also includes a second cord segment that has a plurality of stops spaced along the second cord. The second cord segment extends from a second end cap that is sized and configured to connect to the second end of the bottom rail. A second anchor is connected to the second cord segment. At least one of the second end cap and the second anchor is sized and configured to connect to the second cord segment at a selected stop on the second cord segment.

The first cord segment and the second cord segment can be portions of one cord or separate cords. The plurality of stops of the first cord segment and second cord segment are preferably beads or knots. The first and second end caps may each have at least one slit or keyhole.

In some embodiments, the first anchor or the second anchor can include a retention portion that has a recess sized to receive a stop and a moveable portion configured to move from an open position to a closed position. A stop can be positioned within the recess of the retention portion when the moveable portion is in the open position. The stop can be retained within the anchor when the moveable portion is moved to the closed position. Of course, both the first anchor and the second anchor may each have a retention portion and a moveable portion.

In some embodiments, the moveable portion and the retention portion are parts of a unitary structure. In other embodiments, the moveable portion is connected to the retention portion such that the moveable portion is completely separable from the retention portion or is moveably connected to the retention portion such that the moveable portion can move relative to the retention portion.

The safety device may further include a first receptacle and a second receptacle. The first receptacle is sized and configured to retain the first anchor. The second receptacle is sized and configured to retain the second anchor. In one embodiment, the first and second receptacles are configured to retain the anchors such that the receptacles releasably retain the anchors.

A safety device kit for window coverings is also provided. The safety device kit may include a first cord segment that has a plurality of stops spaced along the first cord segment, a first anchor that is sized and configured to connect to the first cord segment, a second cord segment having a plurality of stops spaced along the second cord segment and a second anchor that is sized and configured to connect to the second cord segment.

Each component of the kit may be provided in separate packages or in one package. In some embodiments, the first anchor and first cord segment may be packaged together and the second cord segment and the second anchor can be packaged together. In other embodiments, multiple kits are provided in one package.

A first end cap and a second end cap may also be included in my kit. For such embodiments, at least one of the first end cap and the first anchor is sized and configured to releasably connect to the first cord segment at a selected stop on the fist cord segment. At least one of the second end cap and second anchor is sized and configured to releasably connect to the second cord segment at a selected stop on the second cord segment. In some embodiments, the first and second end caps can have a slit or a keyhole.

In some embodiments, the kit may include instructions describing how to install the safety kit or retrofit the safety device on an existing window covering. The instructions may be on packaging that encloses one or more components of the kit, located on an internet website, be a separate document within a package containing the kit or be instructional information that is otherwise provided with the kit. In some embodiments, the instructions may include video or audio instructions.

My kit may also include screws or nails. In some embodiments, the first and second anchors will have one or more holes that are sized and configured to receive such screws or nails.

Other objects and advantages of the present invention will become apparent from a description of certain present preferred embodiments thereof shown in the drawings.

BRIEF DESCRIPTION OF THE DRAWINGS

Certain present preferred embodiments of the present invention are illustrated in the accompanying drawings.

DETAILED DESCRIPTION OF THE PRESENT PREFERRED EMBODIMENTS

Figure 1:
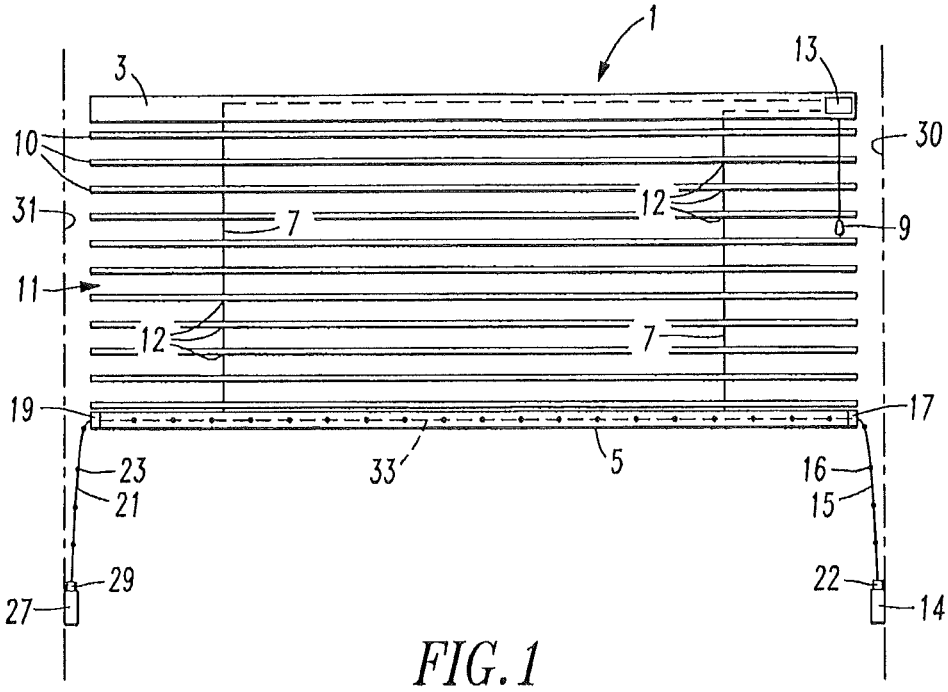
FIG. 1 is a front view of a first present preferred window covering containing my safety device.
Figure 2:
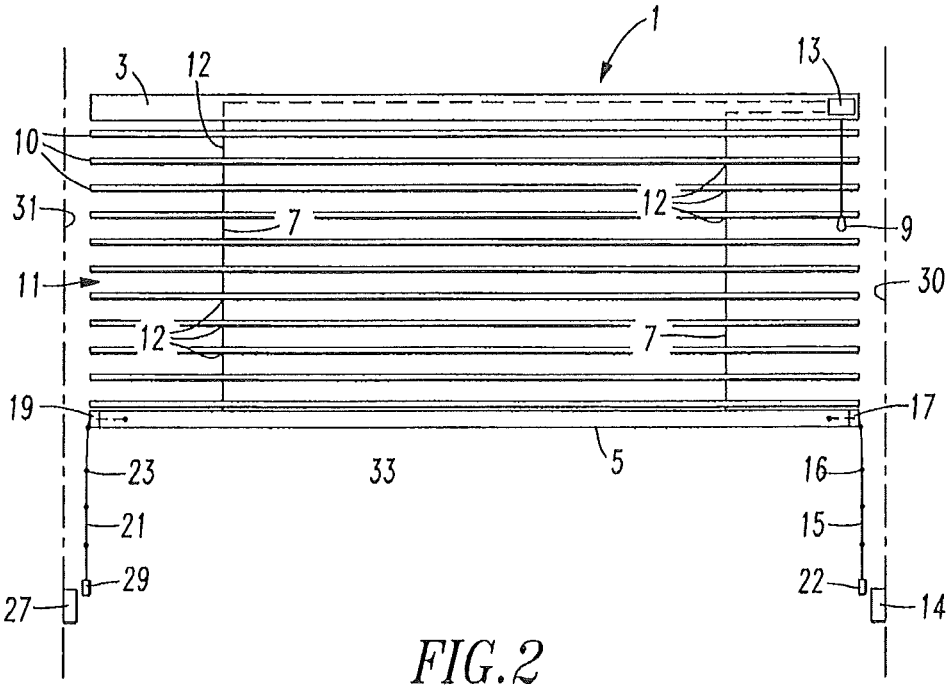
FIG. 2 is a front view of the window covering and safety device shown in FIG. 1 with the window covering material and bottom rail partially raised and the first and second anchors separated from the first and second receptacles.

Referring to FIGS. 1 and 2, a first present preferred embodiment 1 of my window covering containing a safety device is shown. The first embodiment 1 has a headrail 3, lift cords 7 that extend from the headrail 3 to window covering material 11 and a bottom rail 5. Lift cords 7 are connected to an operator cord 9 that extends through a cord lock 13 attached to the headrail. A user may manipulate the operator cord 9 to raise or lower the window covering material 11, which are slats 10 on rope ladders 12. In some embodiments, the bottom rail 5 may be the bottommost slat that has at least one channel formed within the slat.

The bottom rail has two ends. A first end cap 17 is connected to the first end of the bottom rail. The safety device has a first cord segment 15 that has stops 16. The cord segment extends from the first end cap 17. A first anchor 22 is connected to the first cord segment 15 and is releasably retained within first receptacle 14. The first receptacle is affixed to a side of the window frame 30 adjacent the window covering 1.

A second end cap 19 is connected to the second end of the bottom rail 5. A second cord segment 21 extends from the second end cap. The second cord segment has stops 23. A first anchor 29 is releasably retained within second receptacle 27. The second receptacle 27 is affixed to a side of the window frame 31 that is opposite side 30. In other embodiments, both receptacles 14 and 27 could be affixed to the same side of the window frame, below the window covering.

Figure 6:
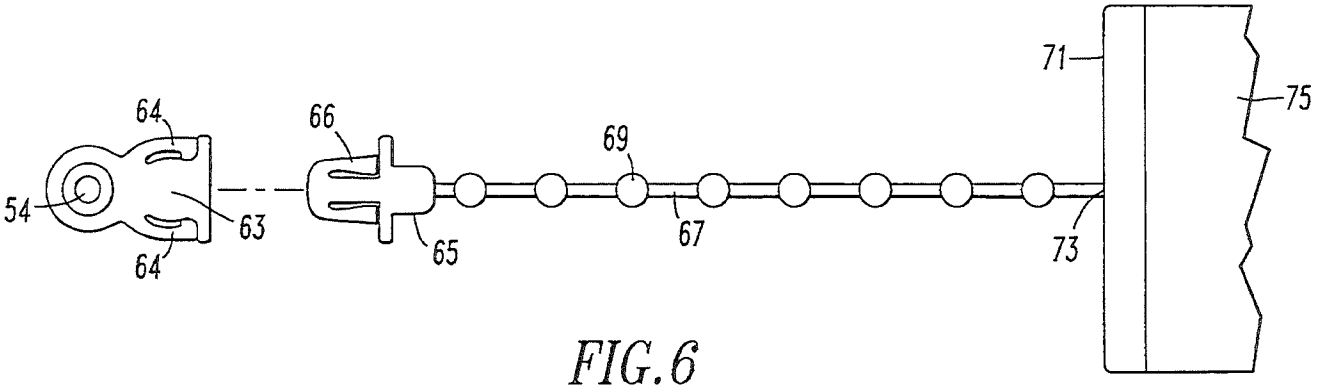
FIG. 6 is a top plan view of a present preferred embodiment of my safety device with the first anchor separated from the first receptacle.

The first end cap has a slit or keyhole 73 shown in FIG. 6 through which the first cord segment 15 extends. The slit or keyhole is sized such that the stops 16 along the cord segment 15 cannot pass through at least a portion of the slit or keyhole. The portions of the cord segment that do not have stops, however, can pass through the slit or a portion of the keyhole. Similarly, the second end cap 19 has a similar slit or keyhole 73 through which the second cord segment 21 extends. The slit is sized such that the stops 23 cannot pass through the slit or a portion of the keyhole. The cord segments 15 and 21 may be separate cords or be portions of an entire cord 33, which is shown in dotted line in FIG. 1, that extends from cord segment 15 through the bottom rail 5 and out to cord segment 21.

It should be appreciated that cord segments 15 and 21 prevent the bottom rail from being raised when the anchors 22 and 25 are retained by the receptacles 14 and 27. To raise the window covering to a new position, a user disconnects the anchors 22, 29 from the receptacles 14, 27, as shown in FIG. 2. The user may then manipulate the operator cord 9 to raise the window covering material. To ensure the bottom rail 5 is maintained at the new position, a user can readjust the length of the cord segments 21, 15, so the cords 15 and 21 may extend sufficiently for the anchors 22 and 29 to be retained within the receptacles 14 and 27.

A user may remove the end caps 17 and 19 from the bottom rail to adjust the length of cord segments 15 and 21 that extend from the respective end caps. The length may be extended by removing the cord segment 15 or 21 from the slit or keyhole of the end cap 17 or 19 and subsequently inserting a different portion of the cord segment 15 or 21 through the slit or keyhole to adjust the length of the cord segment 15 or 19 extending from the end cap 17 or 19 so the anchors 22 and 29 may extend into their respective receptacles 14 and 27.

Figure 3:
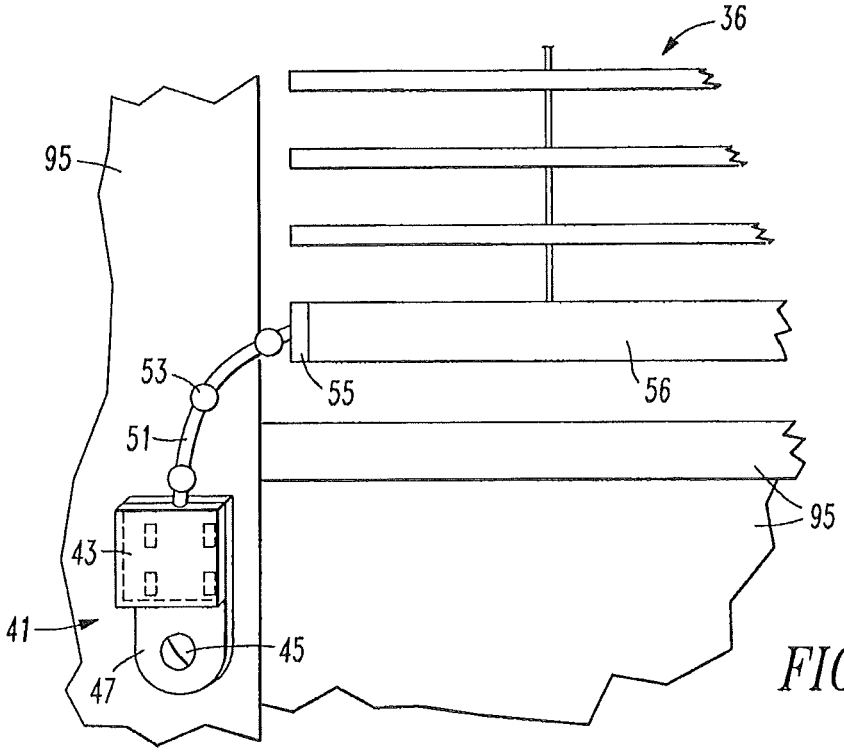
FIG. 3 is a fragmentary view of a second present preferred embodiment of my window covering containing a safety device with the moveable portion of the anchor in the closed position.
Figure 4:
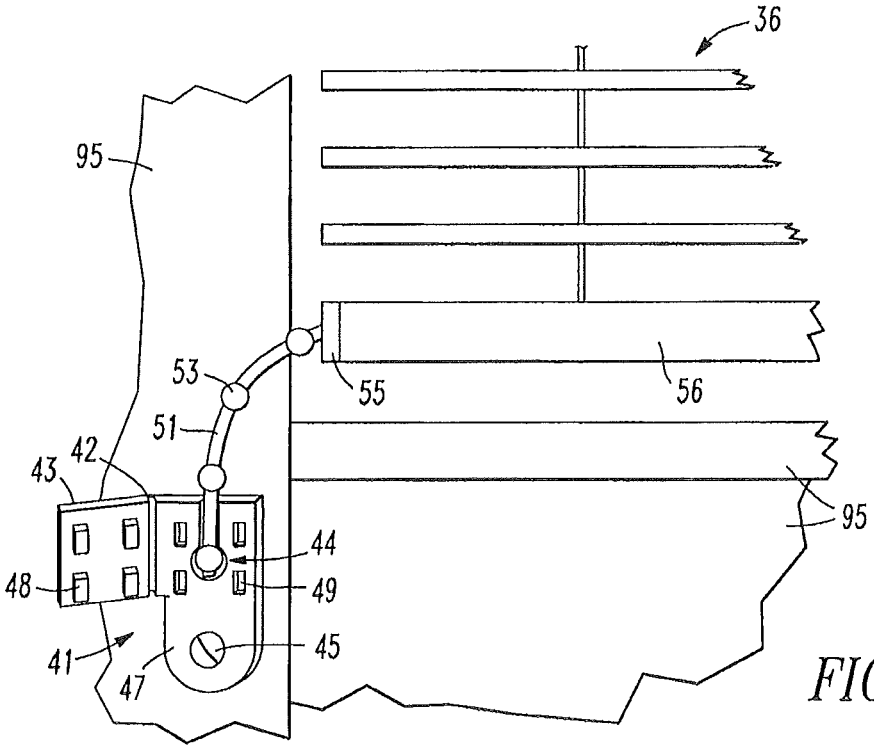
FIG. 4 is a fragmentary view similar to FIG. 3 with the moveable portion of the anchor in an open position.

Of course, other embodiments of my window covering do not need to have safety device containing a receptacle that retains an anchor. Referring to FIG. 3, window covering 36 has a cord segment 51 with stops 53 that extend from each end cap 55 attached to a bottom rail 56. The cord segments 51 extend to anchors 41 affixed to a window frame 95 by screws 45 that extend through holes in the anchors 41. Each anchor 41 has a retention portion 47 and a moveable portion 43 that is moveable about connection 42 from a closed position, which is shown in FIG. 3, to at least one open position, which is shown in FIG. 4. The moveable portion 43, connection 42 and retention portion 47 form a unitary structure.

When the moveable portion is in an open position, a portion of the cord segment having a stop 53 may be positioned within a recess 44 formed in the retention portion 47 of the anchor 41 or removed from the anchor 41. A portion of the cord 51 may be retained within the anchor 41 when the moveable portion 43 is moved to the closed position after a cord portion having a stop 53 is inserted into the recess 44.

The moveable portion is preferably configured so that it may be maintained in the closed position by releasably interlocking with the retention portion. The moveable portion may have resilient projections 48 that are sized and configured to releasably interlock with holes 49 in the retention portion. A user may open the moveable portion by exerting a force on the moveable portion or the retention portion that forces the pins 48 out of their interlocked engagement with the holes 49.

For example, the retention portion and moveable portions may be configured so that a user may squeeze the retention portion to force the pins 48 out of an interlocked fit with the holes 49. In other embodiments, the moveable portion and retention portion can be configured so a certain force pushing the moveable portion away from the retention portion is sufficient to cause the pins 48 to release from their interlocked engagement with holes 49. Of course, other releasable interlocking mechanisms known to those skilled in the art may be used to maintain the moveable portion in a closed position. For example, a latch may extend from the moveable portion and be configured to interlock with a corresponding opening on the retention portion.

It should be understood that the window covering material of the window covering may be composed of slats on ladders, as shown in FIGS. 1-4, or other window covering material such as cellular material, pleated material, faux wood, woven grasses, fabrics, films, and other sheets of material. The window covering may have pull cords, a loop cord drive or be a cordless blind.

Figure 5:
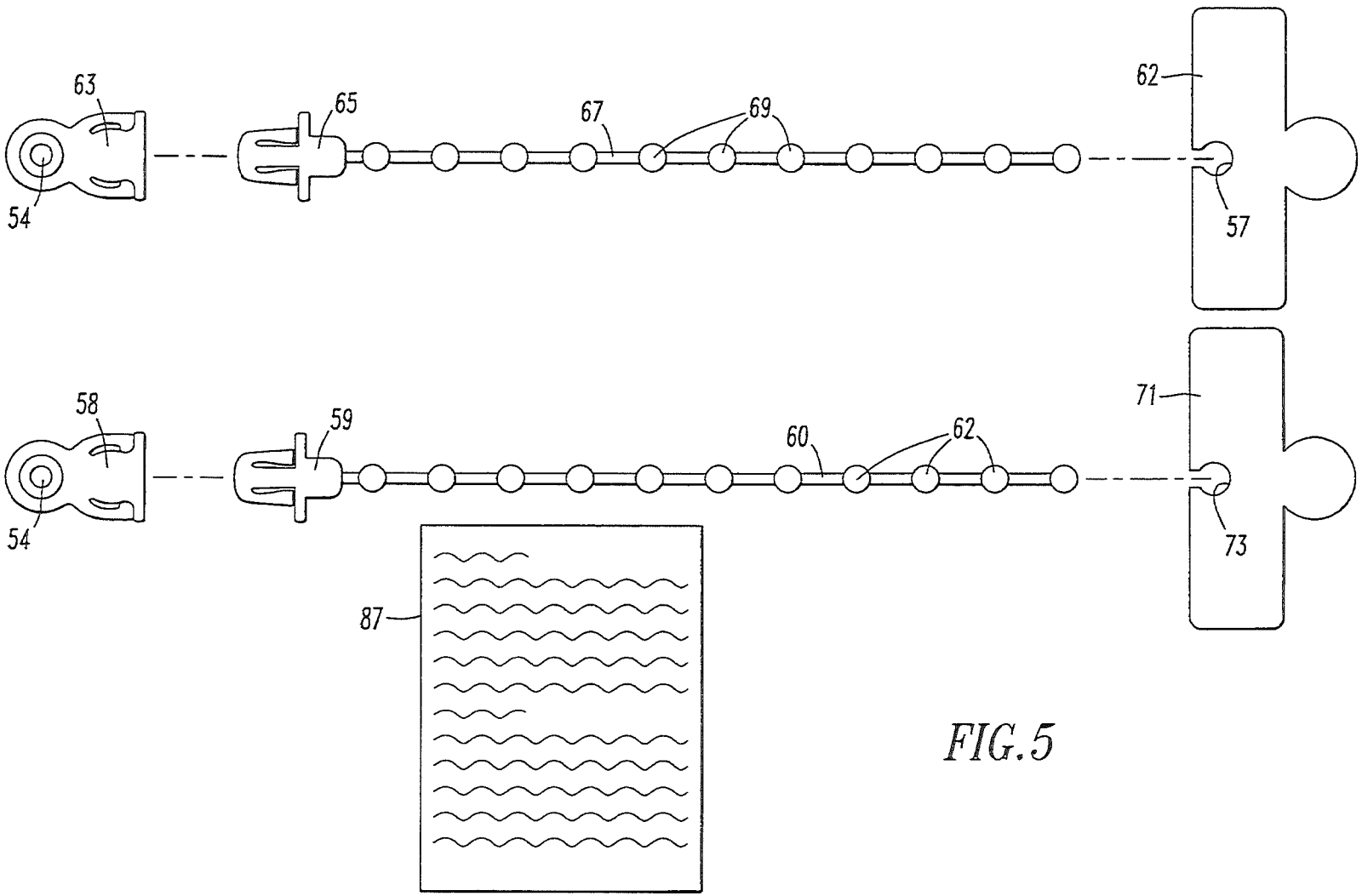
FIG. 5 is an exploded view of a first present preferred embodiment of my safety device kit.

I also provide a kit for retrofitting or installing a safety device on a window covering. One embodiment 54 of such a kit is illustrated in FIG. 5. That kit 54 includes a first end cap 71 that has a keyhole 73, a second end cap 62 that has a keyhole 57, a first cord segment 67 with stops 69, a second cord segment 60 with stops 61, a first anchor 65 connected to the first cord segment, a second anchor 59 connected to the second cord segment 60, a first receptacle 63 and a second receptacle 58. The first receptacle 63 has a cavity (not shown) that is sized and configured to retain the first anchor 65. Similarly, the second receptacle 58 has a cavity (not shown) that is sized and configured to retain the second anchor 59. Installation instructions 87 may be included in the kit or printed on the package for the kit.

The instructions should explain actions an installer must perform to connect different components of the kit to the window covering. The instructions may explain how to operate the safety device once it is installed or retrofitted on a window covering. The instructions can also explain how to install or retrofit my safety device to the cord segments and anchors to a window covering to form the safety device. For example, embodiments of my kit that do not have end caps may instruct an installer to create a slit in the existing end caps of a bottom rail that can receive a cord segment, but not the stops of the cord segments. The instructions may then ask the installer to position the cords to extend from the end caps at a desired length and attached the cord segments to respective anchors. In some embodiments, the anchors may already be connected to the cord segments and be configured to fit within receptacles. For such embodiments, the instructions may explain that an installer can position the cord segments so the anchors extend out of the end cap toward a window frame and that the anchors can be interlocked within a respective receptacle that can be affixed to the side of a window frame or be directly affixed to the side of a window frame.

The receptacles 58 and 63 each have a hole 54 sized to receive a screw or nail. Some embodiments of my kit may also come with screws sized to fit within holes in the receptacles or anchors to affix the anchors or receptacles to the window frame adjacent the window covering.

The end cap keyholes 73 and 57 are sized and configured to have a narrow opening, or slot, in communication with a larger opening above the narrow opening. The larger openings are sized and configured to permit stops on the cord segments to pass through the larger opening portion of the keyhole. The narrow openings are sized and configured to prevent the stops from passing through the narrow opening. The end caps 71 and 62 are sized and configured to be connected to a bottom rail of a window covering such that the end caps can be removed from the bottom rail. Preferably, the large opening of the keyhole is positioned in each end cap so that a portion of the bottom rail covers the large opening of the keyhole when the end cap is connected to the bottom rail.

Figure 7:
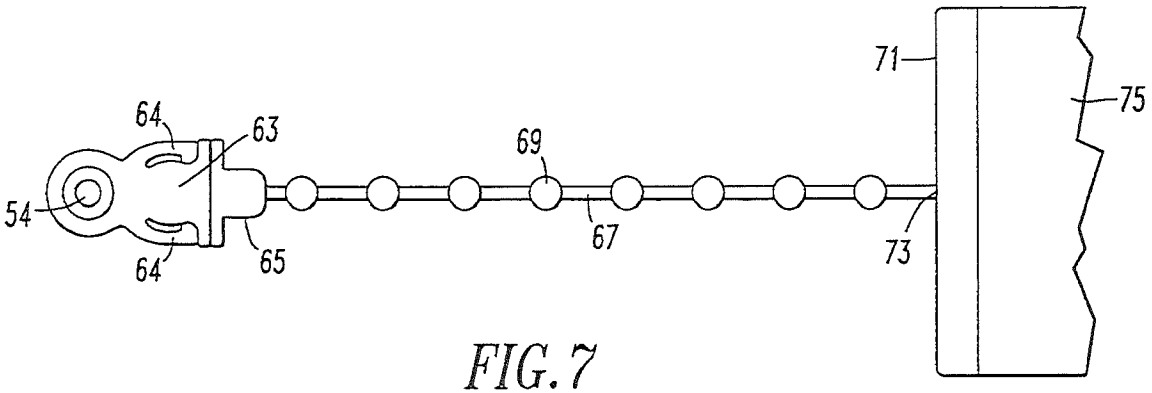
FIG. 7 is a top plan view similar to FIG. 6 illustrating the first anchor retained in the first receptacle.

As shown in FIGS. 6 and 7, the anchors may be inserted into the receptacles or released from the receptacles. For instance, when first anchor 65 is inserted into first receptacle 63, as shown in FIG. 7, the side members 66 of the first anchor are retained within a cavity in the receptacle 63. The side members 64 of the receptacle 63 may be pressed by a user to cause the receptacle to release the anchor 65 such that the anchor can be removed from the receptacle 63, as shown in FIG. 6.

Figure 8:
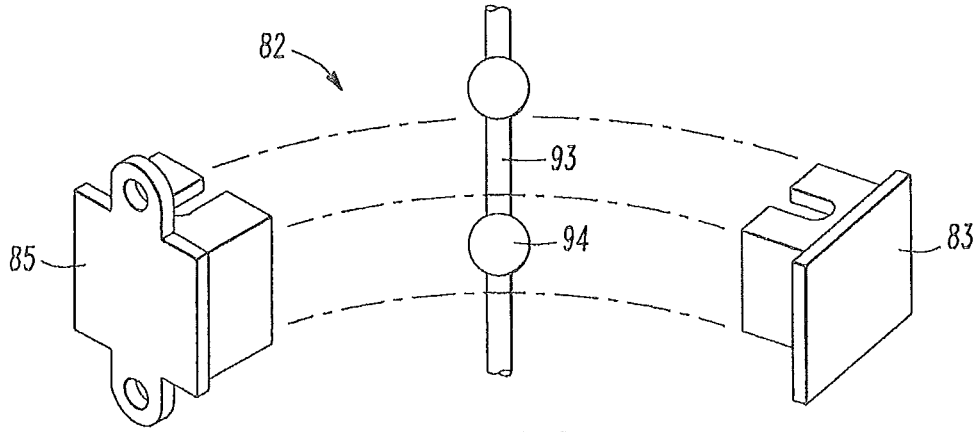
FIG. 8 is a fragmentary view of a second present preferred embodiment of my safety device.

Of course, other embodiments of my kit may have anchors that are configured to lock the position of a bottom rail at multiple raised positions by retaining different stops of a cord segment that extends from a bottom rail. For example, one embodiment of such a kit is shown in FIG. 8. The kit includes an anchor 82 that has a moveable portion 83 that can releasably connect to a retention portion 85. The retention portion 85 has holes sized and configured for screws or nails so the retention portion can be affixed to the side of a window frame. The moveable portion 83 has a slit sized to receive portions of a cord segment 93. The moveable portion 83 and retention portion 85 also have recesses (not shown) sized and configured to retain a stop 94 on the cord segment 93. The moveable portion can be moved to an open position by being separated from the retention portion 85 and can be moved to a closed position by being connected to the retention portion. The length of the cord that extends form a bottom rail to the anchor can be adjusted by having the anchor retain different stops 94 on the cord segment 93. When the entire cord segment is not used to maintain a bottom rail's position, the anchor 82 may be positioned to retain a stop that is between the end of the cord segment and the end of the bottom rail. The remaining portion of the cord segment 93 may extend past the anchor 82.

Figure 9:
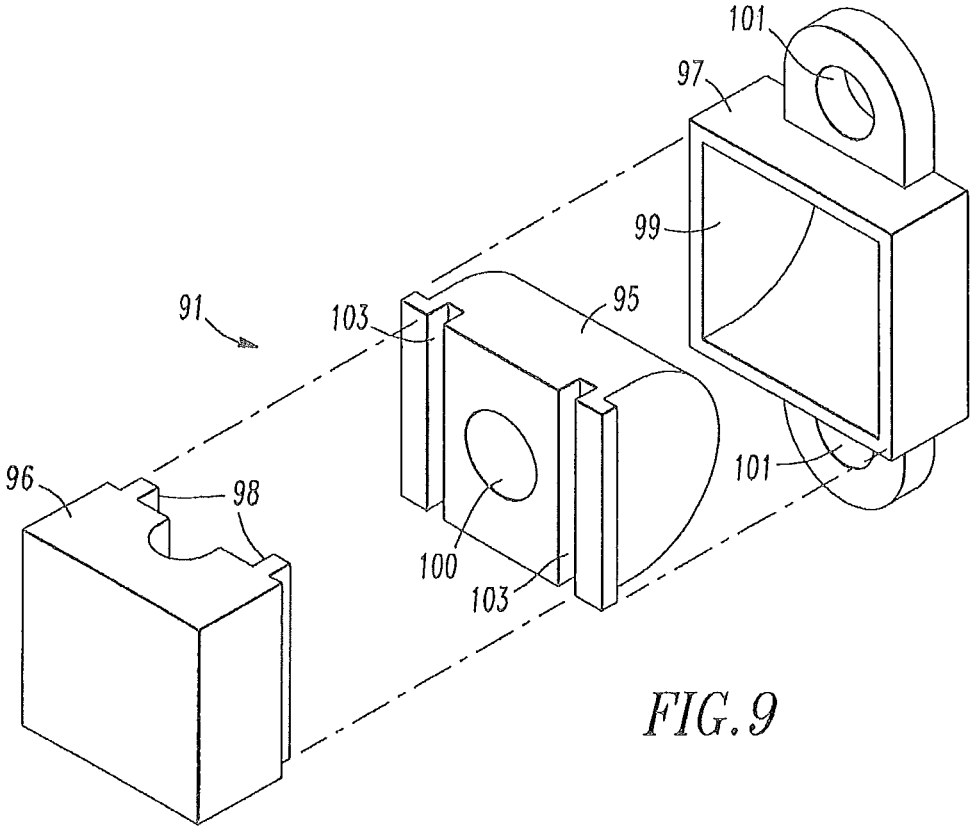
FIG. 9 is an exploded view of a present preferred embodiment of an anchor that may be included in of my kit or safety device attached to a window covering.

Other embodiments of my kit may have anchors 91 that include more than two parts, as shown in FIG. 9. Anchor 91 has a moveable portion 91 that is separable form a retention portion 95. The retention portion has a recess 100 that is sized and configured to receive a stop on a cord segment. The moveable portion 96 has a slot that is sized and configured to receive a portion of a cord segment that includes a stop. The moveable portion 96 has rails 98 that are sized and configured to releasably interlock with channels 103 formed in the retention portion. The channels 103 are configured to release the rails 98 when a certain force is applied to the sides of the retention portion that press in on the retention portion.

The retention portion 95 is sized and configured to connect to a fastening portion 97. The fastening portion 97 has a cavity 99 that is sized and configured to permanently connect to the retention portion 95. The retention portion may be molded to the fastening portion 97, adhered to the fastening portion 97 or otherwise affixed to the fastening portion. The fastening portion 97 has holes 101 sized and configured to receive screws or nails so the fastening portion can be connected to a side of a window frame.

The end caps, receptacles, anchors and stops are preferably molded plastic. They could be metal or a composite material. The cord segments can be cotton, polyester or other material used for cords in window coverings.

Although the stops are illustrated as being spherical they could be cylindrical, cubical, polygonal or another shape that can be retained by the end cap.

Although I have described and illustrated certain present preferred embodiments of my safety device and methods of using, selling and practicing the same, the invention is not limited thereto and may be variously embodied within the scope of the following claims.

I claim:

1. A safety device kit for window coverings comprising:

a first cord segment having a plurality of first stops spaced along the first cord segment;

a first anchor that is sized and configured to connect to the first cord segment, the first anchor being fastenable to a structure adjacent a window opening;

a second cord segment having a plurality of second stops spaced along the second cord segment; and a second anchor that is sized and configured to connect to the second cord segment, the second anchor being fastenable to the structure adjacent the window opening;

the first cord segment having a first end and a second end opposite the first end of the first cord segment, the first end of the first cord segment attachable to the first anchor and the second end of the first cord segment being positionable within a first end portion of a bottom rail of a window covering;

the second cord segment having a first end and a second end opposite the first end of the second cord segment, the first end of the second cord segment attachable to the first anchor and the second end of the second cord segment being positionable within a second end portion of the bottom rail of the window covering, the second end portion of the bottom rail of the window covering being opposite the first end portion of the bottom rail;

the first cord segment and the second cord segment not being a portion of any lift cord extending from a headrail to the bottom rail of the window covering;

a first end cap sized for attachment to the first end portion of the bottom rail and a second end cap sized for attachment to the second end portion of the bottom rail;

a plurality of fasteners comprising a first fastener and a second fastener, the first fastener insertable within the first anchor to attach the first anchor to the structure adjacent the window opening and the second fastener insertable within the second anchor to attach the second anchor to the structure adjacent the window opening; and wherein the first end cap is sized and configured to releasably connect to the first cord segment at a plurality of different selectable first stops of the plurality of first stops of the first cord segment to adjustably position the second end of the first cord segment within the bottom rail and the second end cap sized and configured to releasably connect to the second cord segment at a plurality of different selectable second stops of the plurality of second stops of the second cord segment to adjustably position the second end of the second cord segment within the bottom rail.

2. The kit of claim 1 wherein the first end cap has one of a slit and a keyhole and the second end cap has one of a slit and a keyhole.

3. The kit of claim 1 wherein the plurality of first stops of the first cord segment and the plurality of second stops of the second cord segment are stops selected from a group consisting of beads and knots.

4. The kit of claim 1 wherein the structure adjacent the window opening is a window frame.

5. A safety device kit for window coverings comprising:

a first cord segment having a plurality of first stops spaced along the first cord segment;

a first anchor that is sized and configured to connect to the first cord segment, the first anchor being fastenable to a structure adjacent a window opening;

a second cord segment having a plurality of second stops spaced along the second cord segment; and a second anchor that is sized and configured to connect to the second cord segment, the second anchor being fastenable to the structure adjacent the window opening;

the first cord segment having a first end and a second end opposite the first end of the first cord segment, the first end of the first cord segment attachable to the first anchor and the second end of the first cord segment being positionable within a first end portion of a bottom rail of a window covering;

the second cord segment having a first end and a second end opposite the first end of the second cord segment, the first end of the second cord segment attachable to the first anchor and the second end of the second cord segment being positionable within a second end portion of the bottom rail of the window covering, the second end portion of the bottom rail of the window covering being opposite the first end portion of the bottom rail;

a first end cap sized for attachment to the first end portion of the bottom rail and a second end cap sized for attachment to the second end portion of the bottom rail; and the first end cap being sized and configured to releasably connect to the first cord segment at multiple first stops of the plurality of first stops of the first cord segment to adjustably connect the first cord segment to the first end cap so a length of the first cord segment that extends between the first end cap and the first anchor is adjustable;

the second end cap being sized and configured to releasably connect to the second cord segment at multiple second stops of the plurality of second stops of the second cord segment to adjustably connect the second cord segment to the second end cap so a length of the second cord segment that extends between the first end cap and the first anchor is adjustable;

a plurality of fasteners comprising a first fastener and a second fastener, the first fastener insertable within the first anchor to attach the first anchor to the structure adjacent the window opening and the second fastener insertable within the second anchor to attach the second anchor to the structure adjacent the window opening; and the first cord segment and the second cord segment not being a portion of any lift cord extending from a headrail to the bottom rail of the window covering.

6. The kit of claim 5 wherein the first anchor comprises a retention portion having a recess sized to receive a stop of the plurality of first stops of the first cord segment and a moveable portion configured to move from an open position to a closed position, wherein a stop of the plurality of first stops of the first cord segment is positionable within the recess of the retention portion of the first anchor when the moveable portion of the first anchor is in the open position and is retainable within the first anchor when the moveable portion is moved to the closed position; and wherein the second anchor comprises a retention portion having a recess sized to receive a stop of the plurality of second stops of the second cord segment and a moveable portion configured to move from an open position to a closed position, wherein a stop of the plurality of second stops of the second cord segment is positionable within the recess of the second anchor when the moveable portion of the second anchor is in the open position and is retainable within the second anchor when the moveable portion of the second anchor is in the closed position.

7. The kit of claim 6 wherein the moveable portion of the anchor and the retention portion of the first anchor are a unitary structure and the moveable portion of the second anchor the retention portion of the second anchor are a unitary structure.

8. The kit of claim 5 wherein the fasteners are screws or nails and wherein the first anchor has at least one hole sized and configured to receive a screw or nail and the second anchor has at least one hole sized and configured to receive a screw or nail.

9. The kit of claim 8 wherein the structure adjacent the window opening is a window frame.

* * * * *